US011390512B2

(12) United States Patent
Yanes et al.

(10) Patent No.: US 11,390,512 B2
(45) Date of Patent: Jul. 19, 2022

(54) O-RING RETAINING APPARATUS FOR A BAR GUN

(71) Applicant: TAPRITE, INC., San Antonio, TX (US)

(72) Inventors: Gilbert Yanes, Boerne, TX (US); Jose Cervantes, San Antonio, TX (US); Joseph Paul Kirchberg, San Antonio, TX (US)

(73) Assignee: Taprite, Inc., San Antonio, TX (US)

( * ) Notice: Subject to any disclaimer, the term of this patent is extended or adjusted under 35 U.S.C. 154(b) by 0 days.

(21) Appl. No.: 17/099,580

(22) Filed: Nov. 16, 2020

(65) Prior Publication Data

US 2021/0147208 A1 May 20, 2021

Related U.S. Application Data

(60) Provisional application No. 62/936,194, filed on Nov. 15, 2019.

(51) Int. Cl.
*B67D 1/00* (2006.01)

(52) U.S. Cl.
CPC .... *B67D 1/0084* (2013.01); *B67D 2001/0093* (2013.01)

(58) Field of Classification Search
CPC ..... B67D 1/0084; B67D 2001/0093
See application file for complete search history.

(56) References Cited

U.S. PATENT DOCUMENTS

| | | | | |
|---|---|---|---|---|
| 3,168,967 | A | 2/1965 | Giampa | |
| 4,986,449 | A * | 1/1991 | Valiyee | B67D 1/0084 137/606 |
| 5,042,692 | A * | 8/1991 | Valiyee | B67D 1/0084 222/144.5 |
| 8,272,536 | B2 | 9/2012 | Valiyee et al. | |
| 8,387,829 | B2 | 3/2013 | Schroeder et al. | |
| 8,418,888 | B2 | 4/2013 | Schroeder et al. | |
| 8,459,505 | B2 | 6/2013 | Martindale et al. | |
| 8,770,442 | B2 | 7/2014 | Santy et al. | |
| 2009/0084817 | A1* | 4/2009 | Schroeder | B67D 1/0084 222/144.5 |
| 2009/0230148 | A1* | 9/2009 | Valiyee | B67D 1/0084 222/144.5 |
| 2011/0073617 | A1* | 3/2011 | Martindale | B67D 1/0086 222/144.5 |
| 2016/0029686 | A1 | 2/2016 | Hecht et al. | |

OTHER PUBLICATIONS

International Search Report and Written Opinion dated Feb. 5, 2021 issued in PCT App. No. PCT/US2020/060787 (16 pages).
Wunder-Bar Mark 4 Post-Mix Beverage Dispenser Manual, printed from the internet https://www.wunderbar.com/assets/upload/documentation/M4_English_Manual_2000_504.pdf.

* cited by examiner

*Primary Examiner* — Jeremy Carroll
(74) *Attorney, Agent, or Firm* — Haynes and Boone, LLP; William B. Nash; Jason Whitney

(57) ABSTRACT

A system and method of using an O-ring retaining apparatus to maintain an O-ring in the same position relative to the position of the handle of a bar gun while permitting a valve stem in physical contact with the O-ring to slide past without the O-ring becoming dislodged.

3 Claims, 7 Drawing Sheets

203

O-RING RETAINING APPARATUS FOR A BAR GUN

CROSS-REFERENCE TO RELATED APPLICATIONS

This application claims the benefit of U.S. Provisional Application No. 62/936,194, filed Nov. 15, 2019, which is incorporated by reference herein in its entirety.

TECHNICAL FIELD

This specification relates to the field of beverage dispensing apparatus. More specifically, this application is directed toward systems and methods of an O-ring retaining apparatus for use in a bar gun.

BACKGROUND

Various systems exist to dispense beverages in retail establishments, bars, or restaurants. Included among these are what are termed in the industry various bar-gun apparatus. These systems dispense a beverage by transporting it from a storage location where it may be under pressure, to a flow control manifold rigidly attached to a bar or countertop, into a flexible tubing system to a dispenser apparatus or assembly, which may be called a bar gun. A user may actuate a control, for example a depressible button, on the bar gun to dispense one or more beverages or fluids into a container for consumption. Such bar guns include O-rings to limit leakage of the various fluids out of the bar gun.

Bar-gun apparatus are well-known in the art. U.S. Pat. No. 8,770,442 to Santy et. al shows an exemplary apparatus and method with approaches for the design of a valve stem to retain an O-ring in a bar gun for dispensing, which is incorporated by reference.

U.S. Pat. No. 8,418,888 to Schroeder et. al, shows an exemplary bar gun apparatus with approaches for the design of a backing plate that guides a valve stem for a valve in a bar gun, which is incorporated by.

U.S. Pat. No. 8,387,829 to Schroeder et. al, shows an exemplary bar gun apparatus with approaches for the design of a nozzle assembly to be attached to the end of a bar gun, which is incorporated by reference.

SUMMARY OF THE PRESENT DISCLOSURE

The present disclosure describes improved systems and methods directed toward the use of an O-ring retaining apparatus for use in a beverage dispensing apparatus such as a bar gun. The novel systems and methods in this disclosure enable a user of a bar gun to increase reliability of the O-ring seals in a bar gun, reducing leakage, reducing maintenance, and increasing service life of the bar gun.

DETAILED DESCRIPTION

Various embodiments of improved systems and methods of using an O-ring retaining apparatus in a beverage dispensing apparatus such as a bar gun will now be described with more particular reference to the attached figures. Hereafter, details are set forth by way of example to facilitate discussion of the disclosed subject matter. It should be apparent to a person of ordinary skill in the art, however, that the disclosed embodiments are exemplary and not exhaustive of all possible embodiments.

A first embodiment of a system and method of using an O-ring retaining apparatus in a bar gun is shown in FIGS. 1-4. The apparatus comprises at least one plate rigidly fixed to the body of the bar gun handle to hold the O-rings in place when the bar gun is in operation and contains fluids under pressure. Persons of ordinary skill will recognize that the disclosed embodiment is exemplary only, and that the plate may be made of various metals, may be of different shapes, or that there may be a plurality of plates to retain the O-rings in place, or the means to hold the plate rigidly fixed to the body may vary.

Figure 1:
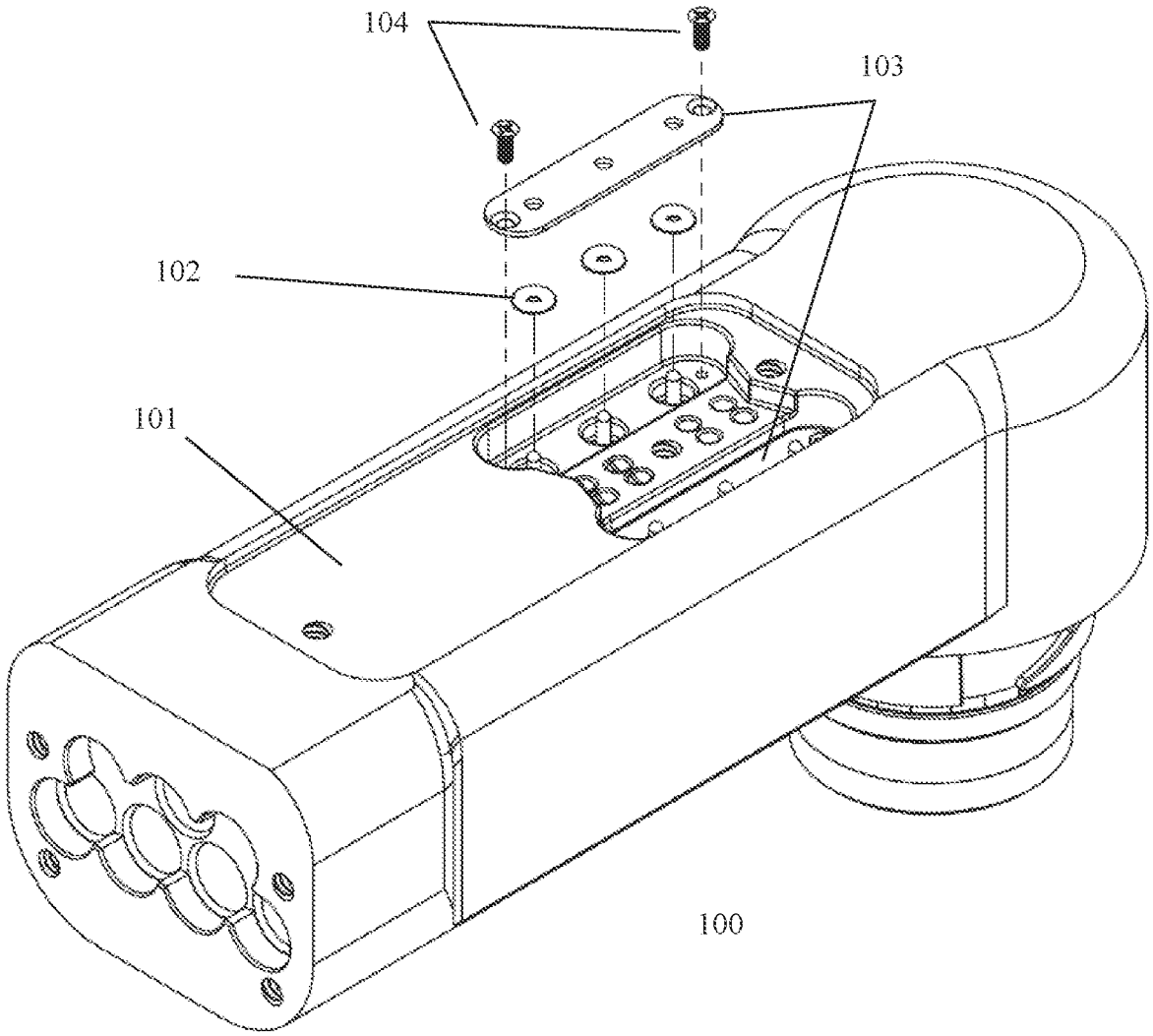
FIG. 1 is a partial exploded perspective view of a bar gun handle in accordance with a first embodiment of the present disclosure.

FIG. 1 shows a partial exploded perspective view of a bar gun handle 100, which is a six-valve bar gun configured for a five-button control panel (not shown). The handle 100 is configured to accept six O-rings 102 with corresponding valve stems that proceed through holes in two retaining plates 103 as shown. The O-ring retaining plates 103 may be constructed of any suitable material, such as metal, plastic, food-grade plastic, other material. The retaining plates 103 are rigidly attached to the body 101 of the bar gun handle 100 by screws 104. In FIG. 1, retaining plates 103 are shown to be installed in a corresponding indentation in the exterior of body 101, but such configuration is not required. For example, there may be no indentation in body 101, or the indentation may be of different dimensions than of the retaining plates 103.

Figure 2:
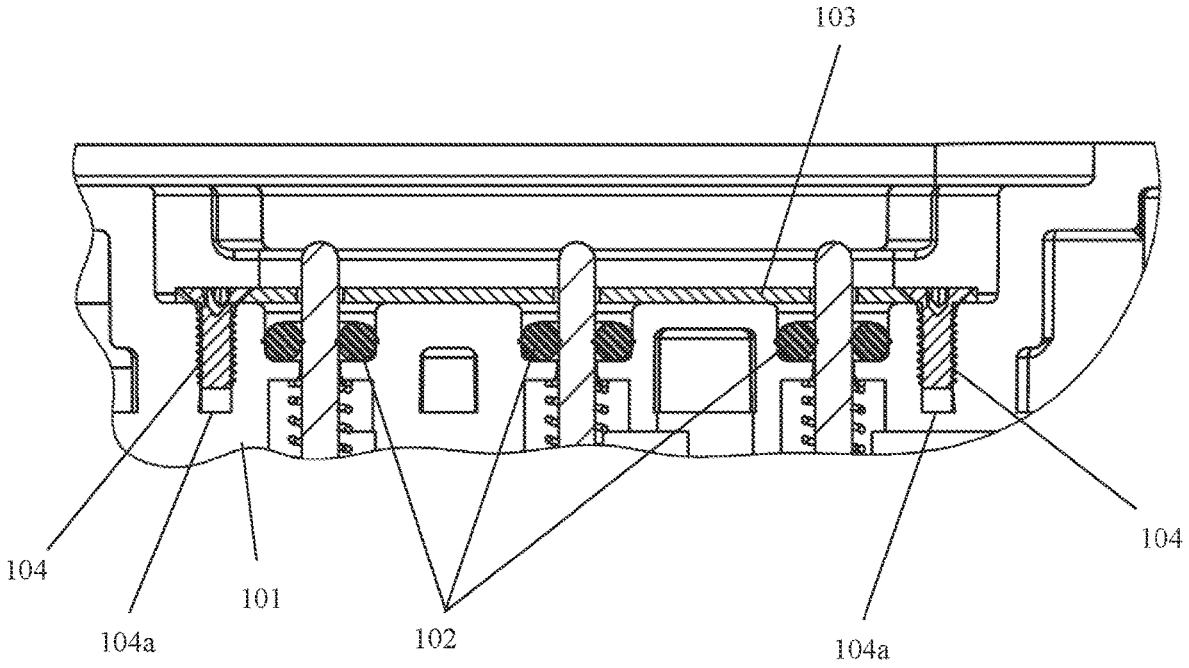
FIG. 2 is a partial cross-sectional view of a bar gun handle in accordance with a first embodiment of the present disclosure.

FIG. 2 is a partial cross-sectional view of the bar gun handle 100 of FIG. 1, showing the vertical plane passing through the valve stems (again, the bar gun's control panel is not shown). As illustrated by FIG. 2, in this embodiment, the installed retaining plate 103 sits on the surface of body 101 and is rigidly attached by screws 104 received in threaded holes or openings **104*a* in the body 101. A user may actuate a button on the control panel to open a valve, which in turns moves one or more valve stems up and down to dispense the desired liquid from the bar gun nozzle. When a user depresses or releases the buttons, O-rings 102 are held in place in their respective indentations in body 101 by retaining plate 103 as the valve stems move up and down shown in FIG. 2**. Thus, the O-rings are retained in place.

Figure 3:
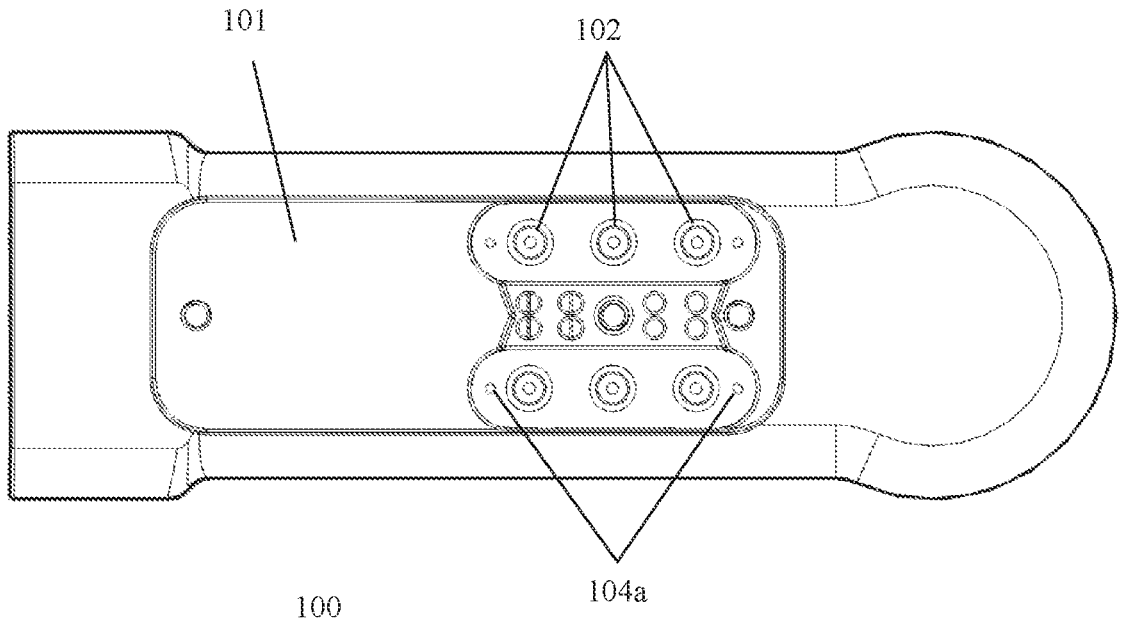
FIG. 3 is a top down image of a partially-assembled bar gun handle in accordance with a first embodiment of the present disclosure.

FIG. 3 shows a top view of a partially-assembled embodiment of bar gun handle 100. Each of the O-rings 102 is shown installed in an indentation or cavity on the top of body 101, the cavity having roughly the same size as the O-rings. As such, the top of the O-ring may be in close proximity or approximately level with the top surface of the bar gun handle's body 101. The installation of the O-rings 102 inside cavities on the top of body 101 is also shown in FIG. 2. Referring to FIG. 3 again, the four threaded holes 104*a* may be situated adjacent to the outermost O-ring indentations so as to receive the screws 104 for attaching the O-ring retaining plates 103, which are not shown in FIG. 3.

Figure 4:
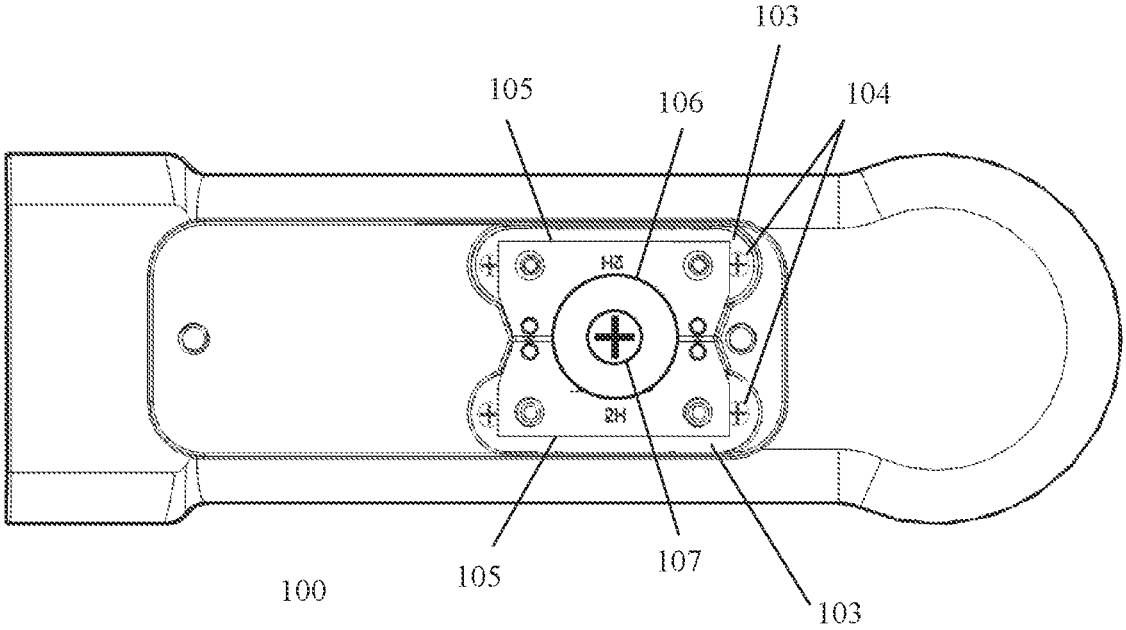
FIG. 4 is a top down image of a partially-assembled bar gun handle with a butterfly actuation plate in accordance with a first embodiment of the present disclosure.

FIG. 4 shows a top view of a partially-assembled embodiment of bar gun 100 with two butterfly plates 105, which are affixed by a washer 106 and screw 107, installed over the top of the O-ring retaining plates 103, which are affixed retain by screws 104. When a user depresses a button (not shown in FIG. 4), the button depresses one or both sides of the butterfly plate, which in turn actuates the valve stems shown in FIG. 1 and FIG. 2.

As an additional feature, it may be possible to permanently or semi-permanently affix or prevent tampering or removal of the retaining plates 103 by various means. For example, the screws 104 shown in FIG. 1 may be installed with thread locker, to inhibit their removal, or high adhesion stickers or caps may be affixed on top of them to inhibit access to the screws 104.

Other means of rigidly attaching, permanently or semi-permanently affixing, or preventing tampering or removal of the O-ring retaining plates 103 are possible. For example, instead of screws being used to hold down the retaining plates, a portion of the body of the bar gun handle may protrude up through the screw holes in the retaining plates 103. These protrusions may comprise posts of the material of construction of the body of the bar gun handle, such as food grade plastic. During manufacture, once the retaining plate is installed, the posts may permanently deformed, such as by high heat, thus making it difficult to remove the retaining plate. If a retaining plate is removed, it cannot be permanently reinstalled, and its prior removal will be evidence during subsequent inspection. In this embodiment, the retaining plates serve an anti-tamper feature in addition to retaining the O-rings in place during operation.

Figure 5:
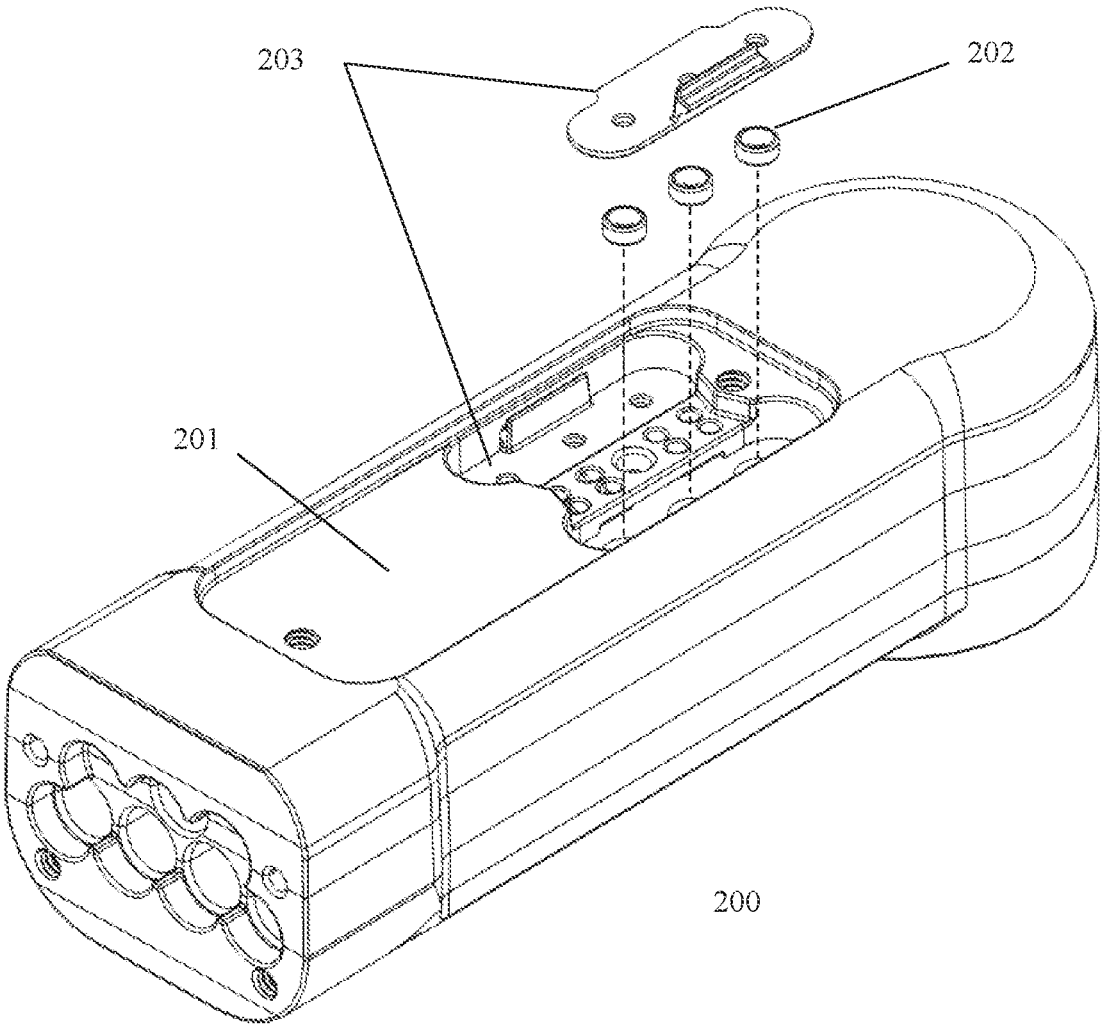
FIG. 5 is a partial exploded perspective view of a bar gun handle in accordance with a second embodiment of the present disclosure.
Figure 6:
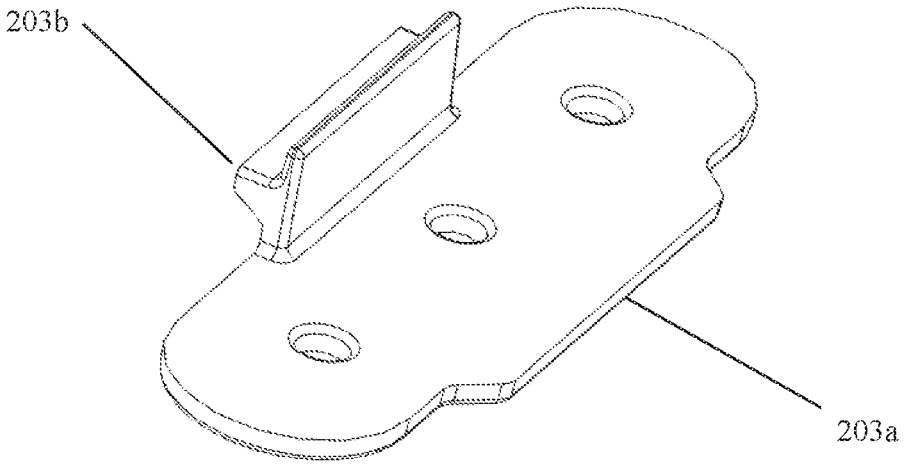
FIG. 6 is a perspective view of a retaining clip in accordance with a second embodiment of the present disclosure.
Figure 7:
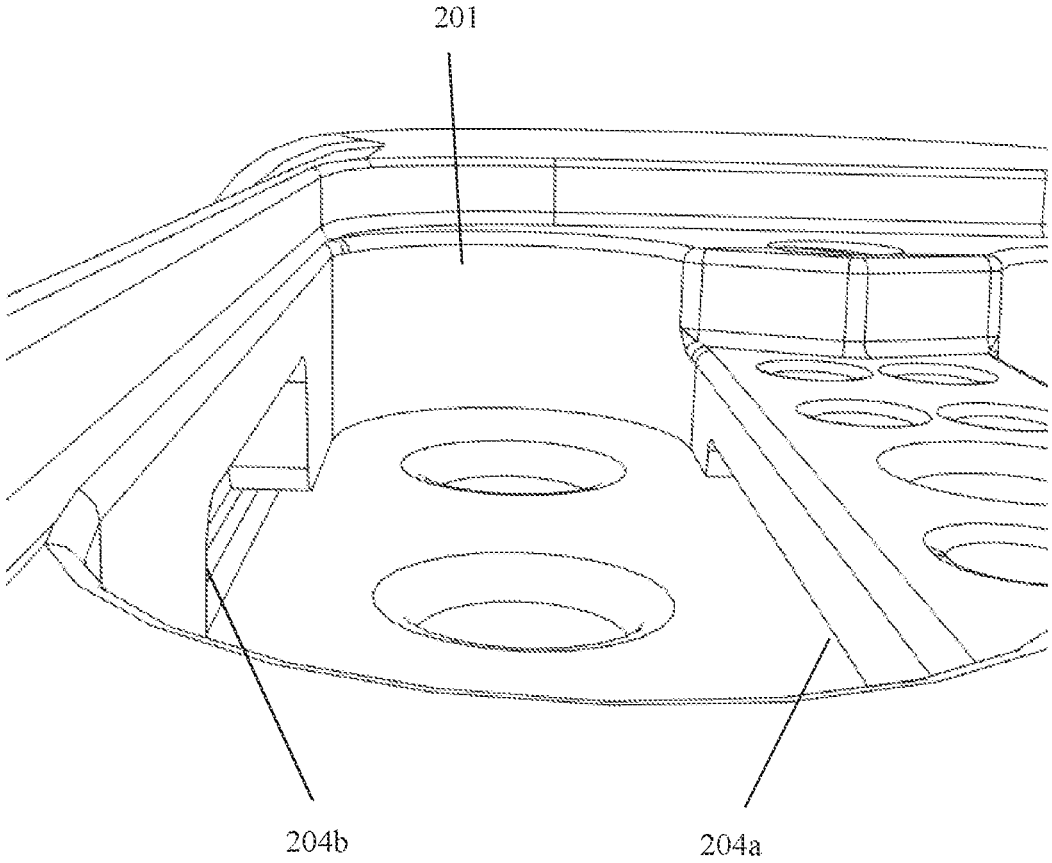
FIG. 7 is an enlarged top perspective view of a bar gun handle showing retaining clip slots in accordance with a second embodiment of the present disclosure.

A second embodiment of a system and method of using an O-ring retaining apparatus in a bar gun is shown in FIGS. 5-7. The apparatus comprises at least one retaining clip inserted into the body of the bar gun handle to hold the O-rings in place when the bar gun is in operation and contains fluids under pressure. The O-ring retaining clip may be made of a semi-flexible material. As used in this disclosure, "semi-flexible" refers to a material that is sufficiently flexible to be deformed by a stainless-steel tool, such as a flat-head screwdriver, but not manually by fingertips or fingernails. The O-ring retaining clip may be of different shapes and there may be a plurality of clips to retain the O-rings in place.

FIG. 5 shows a partial exploded perspective view of a bar gun handle 200, which is a six-valve bar gun configured for a five-button control panel (not shown). The handle 200 is configured to accept six tonic joints or O-rings 202 with corresponding valve stems that proceed through holes in two retaining clips 203. The six O-rings 202 may have D-shaped cross sections or other cross-sectional shapes known in the art. The O-ring retaining clips 203 may be constructed of any suitable semi-flexible material, such as plastic, food-grade plastic, or other material. The retaining clips 203 may be inserted into one or more openings located in the body 201 of the bar gun handle 200 to restrain the O-rings 202.

FIG. 6 shows a perspective view of one embodiment of an O-ring retaining clip 203. As illustrated, the O-ring retaining claim 203 comprises an internal tab or flange 203*a* and an external tab or flange 203*b*.

FIG. 7 shows an enlarged top perspective view of bar gun handle 200 having slots or openings in the body 201 adapted to accept an O-ring retaining clip 203. As shown in FIG. 7, the body 201 may include an internal opening 204*a* and an external opening 204*b* to accommodate an O-ring retaining clip 203. The internal opening 204*a* is shaped to accept the corresponding internal tab 203*a* of an O-ring retaining clip 203, and the external opening 204*b* is shaped to accept the corresponding external tab 203*b* of O-ring retaining clip 203. Thus, the bar gun handle 200 includes two symmetric pairs of openings—an internal opening 204*a* and an external openings 204*b* for each of the two O-ring retaining clips 203. Once inserted into bar gun handle 200, the semi-flexible O-ring retaining clips 203 may be removed with a suitable stainless-steel tool or instrument.

A person of ordinary skill will recognize that the semi-flexible O-ring retaining clips 203 may additionally be permanently or semi-permanently affixed to the body 201 of bar gun handle 200. For example, after installation the O-ring retaining clips 203 may be affixed to the body 101 of the bar gun handle 100 by heat, welding or by glue, epoxies, or other by chemical adhesives.

A person of ordinary skill will further recognize that the disclosed O-ring retaining plate 103 and O-ring retaining clip 203 are not restricted to bar gun handles with only six valves, but that many alternatives are possible, including the number of valves. Similarly, a person of ordinary skill will recognize that the disclosed O-ring retaining plates and O-ring retaining clips are not restricted to a bar gun handle with a control panel with only five buttons. Possible alternatives may include a control panel of any multiplicity of buttons.

While the subject of this specification has been described in connection with one or more exemplary embodiments, it is not intended to limit the claims to the particular forms set forth. On the contrary, the appended claims are intended to cover such alternatives, modifications and equivalents as may be included within their spirit and scope.

What is claimed is:

1. An apparatus for retaining O-rings in a beverage dispensing device, comprising:

a handle of a beverage dispensing device;

a first plurality of valves and a second plurality of valves in said handle, wherein each valve of said first plurality of valves and second plurality of valves has a reciprocating valve body with a valve stem rigidly linked thereto;

a first plurality of O-rings installed around the valve stems of the first plurality of valves and in physical contact with the handle of the beverage dispensing device;

a second plurality of O-rings installed around the valve stems of the second plurality of valves and in physical contact with the handle of the beverage dispensing device;

a first steel retaining plate and a second steel retaining plate, the first steel retaining plate having openings to accept the valve stems of the first plurality of valves and the second steel retaining plate having openings to accept the valve stems of the second plurality of valves, each steel retaining plate being separately and rigidly attached to the handle of the beverage dispensing device by a plurality of screws;

wherein said first steel retaining plate retains the first plurality of O-rings in physical contact with the handle and said second steel retaining plate retains the second plurality of O-rings in physical contact with the handle;

wherein the valve stems of the first plurality of valves reciprocate through the first plurality of O-rings and the first retaining plate without dislodging the first plurality of O-rings; and wherein the valve stems of the second plurality of valves reciprocate through the second plurality of O-rings and the second retaining plate without dislodging the second plurality of O-rings.

2. A method for retaining O-rings in a beverage dispensing device, the method comprising:

manufacturing a handle of a beverage dispensing device having a plurality of valve cavities;

installing a plurality of O-rings in physical contact with the handle of the beverage dispensing device;

rigidly and separately attaching at least two retaining plates to the handle of the beverage dispensing device;

wherein each of the at least two retaining plates is rigidly attached using a means to inhibit removal of the retaining plate by a user from the handle of the beverage dispensing device;

wherein said plurality of O-rings are directly adjacent to the plurality of valve cavities; and installing within the plurality of valve cavities a plurality of valve stems rigidly linked to a plurality of valve bodies, wherein each stem of the plurality of the valve stems proceeds through an opening in an O-ring of the plurality of O-Rings and a corresponding opening in the at least two retaining plates such that the valve stem may travel in at least one dimension without dislodging the O-ring.

3. A beverage dispensing device, comprising:

a handle having a plurality of depressible buttons on an exterior face;

two or more butterfly actuation plates situated within the handle, each butterfly actuation plate movable in response to depression of one or more of the depressible buttons;

a plurality of valves situated within the handle, each valve movable in response to actuation of one or more of the butterfly actuation plates, wherein each of the plurality of valves includes an O-ring cavity with an O-ring situated therein, and wherein each O-ring is positioned around a reciprocating value stem passing through said O-ring cavity;

two pairs of opposing slots situated within the handle, each pair of opposing slots situated adjacent to the plurality of valves;

two semi-flexible O-ring retaining clips, each semi-flexible O-ring retaining clip having a pair of opposing retaining tabs adapted to engage the opposing slots in the handle and to retain at least two O-rings within their respective O-ring cavities during reciprocation of the valve stems; and wherein the two semi-flexible O-rings retaining clips are removable by applying a linear force to push one of said opposing retaining tabs towards the other.

* * * * *